US006398627B1

(12) United States Patent
Chiou et al.

(10) Patent No.: US 6,398,627 B1
(45) Date of Patent: Jun. 4, 2002

(54) SLURRY DISPENSER HAVING MULTIPLE ADJUSTABLE NOZZLES

(75) Inventors: Wen-Chih Chiou, Miao-li; Ying-Ho Chen, Taipei; Tsu Shih; Syun-Ming Jang, both of Hsin-Chu, all of (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 0 days.

(21) Appl. No.: 09/815,427

(22) Filed: Mar. 22, 2001

(51) Int. Cl.[7] ..... B24B 9/00

(52) U.S. Cl. ..... 451/72; 451/41; 451/285; 451/446; 451/447

(58) Field of Search ..... 451/72, 41, 87, 451/285, 288, 447, 446, 60, 102

(56) References Cited

U.S. PATENT DOCUMENTS 5,658,185 A * 8/1997 Morgan, III et al.

6,106,728 A * 8/2000 Iida et al.

* cited by examiner

*Primary Examiner*—Joseph J. Hail, III
*Assistant Examiner*—Willie Berry, Jr.
(74) *Attorney, Agent, or Firm*—Tung & Associates

(57) ABSTRACT

A slurry dispensing unit for a chemical mechanical polishing apparatus equipped with multiple slurry dispensing nozzles is disclosed. The slurry dispensing unit is constructed by a dispenser body that has a delivery conduit, a return conduit and a U-shape conduit connected in fluid communication therein between for flowing continuously a slurry solution therethrough and a plurality of nozzles integrally connected to and in fluid communication with a fluid passageway in the delivery conduit for dispensing a slurry solution. The multiple slurry dispensing nozzles may either have a fixed opening or adjustable openings by utilizing a flow control valve at each nozzle opening.

20 Claims, 3 Drawing Sheets

SLURRY DISPENSER HAVING MULTIPLE ADJUSTABLE NOZZLES

FIELD OF THE INVENTION

The present invention generally relates to a polishing slurry dispenser in a chemical mechanical polishing apparatus and more particularly, relates to a polishing slurry dispenser in a chemical mechanical polishing apparatus that is equipped with a plurality of nozzles each having a flow control valve.

BACKGROUND OF THE INVENTION

Apparatus for polishing thin, flat semiconductor wafers is well-known in the art. Such apparatus normally includes a polishing head which carries a membrane for engaging and forcing a semi-conductor wafer against a wetted polishing surface, such as a polishing pad. Either the pad, or the polishing head rotates or oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CME apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A perspective view of a typical CMP apparatus is shown in FIG. 1A. The CMP apparatus 10 consists of a controlled mini-environment 12 and a control panel section 14. In the controlled mini-environment 12, typically four spindles 16, 18, 20, and 22 are provided (the fourth spindle 22 is not shown in FIG. 1A) which are mounted on a cross-head 24. On the bottom of each spindle, for instance, under the spindle 16, a polishing head 26 is mounted and rotated by a motor (not shown). A substrate such as a wafer is mounted on the polishing head 26 with the surface to be polished mounted in a face-down position (not shown). During a polishing operation, the polishing head 26 is moved longitudinally along the spindle 16 in a linear motion across the surface of a polishing pad 28. As shown in FIG. 1A, the polishing pad 28 is mounted on a polishing disc 30 rotated by a motor (not shown) in a direction opposite to the rotational direction of the polishing head 26.

Also shown in FIG. 1A is a conditioner arm 32 which is equipped with a rotating conditioner disc 34. The conditioner arm 32 pivots on its base 36 for conditioning the polishing pad 38 for the in-situ conditioning of the pad during polishing. While three stations each equipped with a polishing pad 28, 38 and 40 are shown, the fourth station is a head clean load/unload (HCLU) station utilized for the loading and unloading of wafers into and out of the polishing head. After a wafer is mounted into a polishing head in the fourth head cleaning load/unload station, the cross head 24 rotates 90° clockwise to move the wafer just loaded into a polishing position, i.e. over the polishing pad 28. Simultaneously, a polished wafer mounted on spindle 20 is moved into the head clean load/unload station for unloading.

A cross-sectional view of a polishing station 42 is shown in FIGS. 1B and 1C. As shown in FIG. 1B, a rotating polishing head 26 which holds a wafer 44 is pressed onto an oppositely rotating polishing pad 28 mounted on a polishing disc 30 by adhesive means. The polishing pad 28 is pressed against the wafer surface 46 at a predetermined pressure. During polishing, a slurry 48 is dispensed in droplets onto the surface of the polishing pad 28 to effectuate the chemical mechanical removal of materials from the wafer surface 46.

An enlarged cross-sectional representation of the polishing action which results form a combination of chemical and mechanical effects is shown in FIG. 1C. The CMP method can be used to provide a planner surface on dielectric layers, on deep and shallow trenches that are filled with polysilicon or oxide, and on various metal films. A possible mechanism for the CMP process involves the formation of a chemically altered layer at the surface of the material being polished. The layer is mechanically removed from the underlying bulk material. An outer layer is then regrown on the surface while the process is repeated again. For instance, in metal polishing, a metal oxide layer can be formed and removed repeatedly.

During a CMP process, a large volume of a slurry composition is dispensed. The slurry composition and the pressure applied between the wafer surface and the polishing pad determine the rate of polishing or material removal from the wafer surface. The chemistry of the slurry composition plays an important role in the polishing rate of the CMP process. For instance, when polishing oxide films, the rate of removal is twice as fast in a slurry that has a pH of 11 than with a slurry that has a pH of 7. The hardness of the polishing particles contained in the slurry composition should be about the same as the hardness of the film to be removed to avoid damaging the film. A slurry composition typically consists of an abrasive component, i.e, hard particles and components that chemically react with the surface of the substrate.

For instance, a typical oxide polishing slurry composition consists of a colloidal suspension of oxide particles with an average size of 30 nm suspended in an alkali solution at a pH larger than 10. A polishing rate of about 120 nm/min can be achieved by using this slurry composition. Other abrasive components such as ceria suspensions may also be used for glass polishing where large amounts of silicon oxide must be removed. Ceria suspensions act as both the mechanical and the chemical agent in the slurry for achieving high polishing rates, i.e, larger than 500 nm/min. While ceria particles in the slurry composition remove silicon oxide at a higher rate than do silica, silica is still preferred because smoother surfaces can be produced. Other abrasive components, such as alumina ($A1_3O_2$)may also be used in the slurry composition.

The polishing pad 28 is a consumable item used in a semiconductor wafer fabrication process. Under normal wafer fabrication conditions, the polishing pad is replaced after about 12 hours of usage. Polishing pads may be hard, incompressible pads or soft pads. For oxide polishing, hard and stiffer pads are generally used to achieve planarity. Softer pads are generally used in other polishing processes to achieve improved uniformity and smooth surface. The hard pads and the soft pads may also be combined in an arrangement of stacked pads for customized applications.

Referring now to FIG. 2, wherein a perspective view of a CMP polishing station 42 is shown. The polishing station 42 consists of a conditioning head 52, a polishing pad 28, and a slurry delivery arm 54 positioned over the polishing pad. The conditioning head 28 is mounted on a conditioning arm 58 which is extended over the top of the polishing pad 28 for making sweeping motions across the entire surface of the pad. The slurry delivery arm 54 is equipped with a single slurry dispensing nozzle 62 which is used for dispensing a slurry solution on the top surface 60 of the polishing pad 56. Surface grooves 64 are further provided in the top surface 60 to facilitate even distribution of the slurry solution and to help entrapping undesirable particles that are generated by coagulated slurry solution or any other foreign particles which have fallen on top of the polishing pad during a polishing process. The surface grooves 64 while serving an important function of distributing the slurry also presents a processing problem when the pad surface 60 gradually worn out after successive use.

The conventional slurry delivery arm 54 is provided with a single outlet as shown in FIG. 4 or with dual outlets as shown in FIG. 2. A slurry solution is dispensed from the single nozzle to the polishing pad surface in a single flow or droplets of the slurry solution at a single location on the polishing pad. The single nozzle slurry dispensing system further contributes to the non-uniformity in polishing by the polishing pad. For instance, as shown in FIG. 3 of a graph plotted of removal rates of copper polishing against the distance on the wafer surface. It is seen that removal rates vary between about 2894 Å/min. and about 3025 Å/min., i.e. representing a range of about 130 Å/min. or a variation of 4–5%. The variation in removal rates between the center of the wafer and the edge of the wafer is not acceptable and must be remedied.

It is therefore an object of the present invention to provide a slurry dispensing unit for a chemical mechanical polishing apparatus that does not have the drawbacks or shortcomings of the conventional slurry dispensing units.

It is another object of the present invention to provide a slurry dispensing unit for a chemical mechanical polishing apparatus that dispenses a polishing slurry from a continuous, closed-loop flow of the slurry solution.

It is a further object of the present invention to provide a slurry dispensing unit for a chemical mechanical polishing apparatus that does not have a single dispensing nozzle.

It is another further object of the present invention to provide a slurry dispensing unit for a chemical mechanical polishing apparatus that is equipped with a plurality of slurry dispensing nozzles.

It is still another object of the present invention to provide a slurry dispensing unit for a chemical mechanical polishing apparatus that is equipped with a plurality of slurry dispensing nozzles wherein each has a different nozzle opening than the neighboring nozzle openings.

It is yet another object of the present invention to provide a slurry dispensing unit for a chemical mechanical polishing apparatus equipped with a plurality of slurry dispensing nozzles wherein the nozzles have the same size opening.

It is still another further object of the present invention to provide a slurry dispensing unit for a chemical mechanical polishing apparatus equipped with a plurality of slurry dispensing nozzles each provided with a flow control valve.

It is yet another further object of the present invention to provide a slurry dispensing unit for a chemical mechanical polishing apparatus equipped with a plurality of adjustable slurry dispensing nozzles.

SUMMARY OF THE INVENTION

In accordance with the present invention, a slurry dispensing unit for a chemical mechanical polishing apparatus equipped with a plurality of adjustable nozzles is provided.

In a preferred embodiment, a slurry dispenser unit for a chemical mechanical polishing apparatus is provided which includes a dispenser body that has a delivery conduit, a return conduit and a U-shape conduit connected in fluid communication therein between for flowing continuously a slurry solution therethrough; and a plurality of nozzles integrally connected to and in fluid communication with a fluid passageway in the delivery conduit for dispensing a slurry solution.

In the slurry dispenser for a chemical polishing apparatus, the plurality of nozzles each has an opening that is the same in size as the openings of its immediately adjacent nozzles. The plurality of nozzles each may have an opening that is different in size than the openings of its immediately adjacent nozzles. The plurality of nozzles each may have an opening that is between about 0.5 mm and about 5 mm in diameter. The plurality of nozzles each has an opening that is controlled by an adjustable flow control valve to provide a slurry dispensing rate between about 0.1 ml/sec. and about 10 ml/sec. The plurality of nozzles may include at least four nozzles, or the plurality of nozzles may include one nozzle for each 12.5 mm spacing on a semiconductor wafer. The plurality of nozzles may include sixteen nozzles when the dispenser is adapted for dispensing slurry on a 300 mm semiconductor wafer. The plurality of nozzles may each have an opening that is controlled by a pneumatically adjusted flow control valve.

The present invention is further directed to a chemical mechanical polishing apparatus for planarizing semiconductor wafers that includes a wafer holder for holding a wafer therein and for rotating, traversing the wafer on a polishing pad; a polishing platen for mounting and rotating a polishing pad mounted thereon; a conditioning arm for operating a conditioning disc mounted thereon and for conditioning a top surface of the polishing pad; and a slurry dispenser that has a body portion of a delivery conduit, a return conduit and a U-shape conduit connected in fluid communication therein between for flowing continuously a slurry solution therethrough; and a plurality of nozzles integrally connected to and in fluid communication with a fluid passageway in the delivery conduit for dispensing a slurry solution.

BRIEF DESCRIPTION OF THE DRAWINGS

These and other objects, features and advantages of the present invention will become apparent from the following detailed description and the appended drawings in which.

DETAILED DESRIPTION OF THE PREFERRED EMBODIMENT

The present invention discloses a slurry dispensing unit for a chemical mechanical polishing apparatus which is equipped with multiple dispensing nozzles. The multiple dispensing nozzles may have the same opening or orifice for the slurry flow, or may have different openings or orifices for the slurry flow.

The slurry dispensing unit may be constructed by a dispenser body that has a delivery conduit, a return conduit and a U-shape conduit connected in fluid communication therein between for flowing continuously a slurry solution through the dispenser body, and a plurality of nozzles integrally connected to and in fluid communication with a fluid passageway in the delivery conduit for dispensing a slurry solution. The plurality of nozzles may have a fixed nozzle opening, or may have adjustable nozzle openings such that the flow rate of the slurry solution through the nozzle opening can be adjusted within a suitable range. For instance, the present invention novel slurry unit that is equipped with multiple adjustable nozzles is capable of dispensing a slurry solution from each nozzle opening at a flow rate between about 0.1 ml/sec. and about 10 ml/sec. The nozzle openings may be between about 0.5 mm and about 5 mm in diameter.

In practicing the present invention novel invention, the multiple adjustable nozzles provided on a slurry dispensing arm may be suitably selected such that there is one nozzle for each 12.5 mm distance on a semiconductor wafer. For instance, for a 300 mm diameter wafer, there would be a total number of sixteen nozzles. However, it has been found that as few as four nozzles may be utilized yet still achieving some of the present invention desirable results.

In the preferred embodiment, a plurality of adjustable nozzles which are manually adjustable is shown. However, it has been demonstrated that pneumatically adjustable flow control valves may be utilized for an automated control of the dispensing nozzles when the dispensing of slurry is controlled by a central processing unit. The pneumatically controlled flow valves may be operated by a solenoid valve that may be electrically controlled for operating the flow control valve.

The invention further discloses a chemical mechanical polishing apparatus for planarizing semiconductor wafers that includes a wafer holder, a polishing platen, a polishing pad, a conditioning arm and a slurry dispensing unit. The wafer holder is adapted for holding a wafer therein and for rotating and traversing the wafer on a polishing pad. The polishing platen is adapted for mounting and rotating a polishing pad adhesively joined thereto, while the conditioning arm operates a conditioning disc mounted thereon for conditioning a top surface of the polishing pad. The slurry dispensing unit is similar to that previously described that may include a plurality of dispensing nozzles that has either a fixed opening or an adjustable opening by using an adjustable flow control valve.

Figure 5:
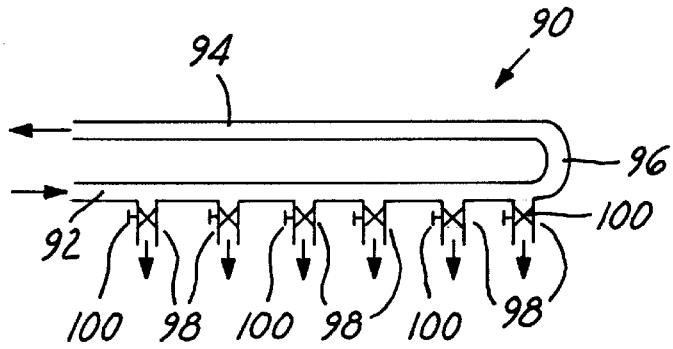
FIG. 5 is a cross-sectional view of a present invention continuous-flow slurry dispensing unit equipped with multiple dispensing nozzles.

Referring now to FIG. 5 wherein a present invention slurry dispensing unit 90 is shown. The slurry dispensing unit 90 is constructed by three conduit sections, i.e. a delivery conduit 92, a return conduit 94 and a U-shape conduit 96 connected therein between. The three conduit sections should have the same internal passage size to insure a continuous, closed-loop flow of a slurry solution therethrough. The delivery conduit may be provided with a plurality of dispensing nozzles 98 each equipped with an adjustable flow control valve 100. The plurality of nozzles 98 may each have an opening that is the same both sides and the opening of its immediately adjacent nozzles, or may have an opening that is different in size than the openings of its immediately adjacent nozzles. When the nozzle openings are formed in a fixed opening, i.e. non-adjustable opening, the nozzle opening may have a diameter between about 0.5 mm and about 5 mm, and preferably in between about 1 mm and about 3 mm.

It is more preferred that the plurality of nozzles 98 is provided with an adjustable flow control valve 100 such that when manually adjusted, as shown in FIG. 5, a slurry dispensing rate between about 0.1 ml/sec. and about 10 ml/sec. may be advantageously obtained.

The total number of the plurality of dispensing nozzles required for a specific application depends on the size of the semiconductor wafer that is being polished in the chemical mechanical polishing apparatus. For instance, it is desirable to provide a nozzle opening for each 12.5 mm spacing on a semiconductor wafer, i.e. for a 300 mm diameter wafer a total number of sixteen dispensing nozzles may be desirable. However, when compared to the conventional slurry dispensing unit that has only a single nozzle opening, even when the present invention dispensing unit is equipped with only four dispensing nozzles, a more desirable result can be achieved.

Figure 1A:
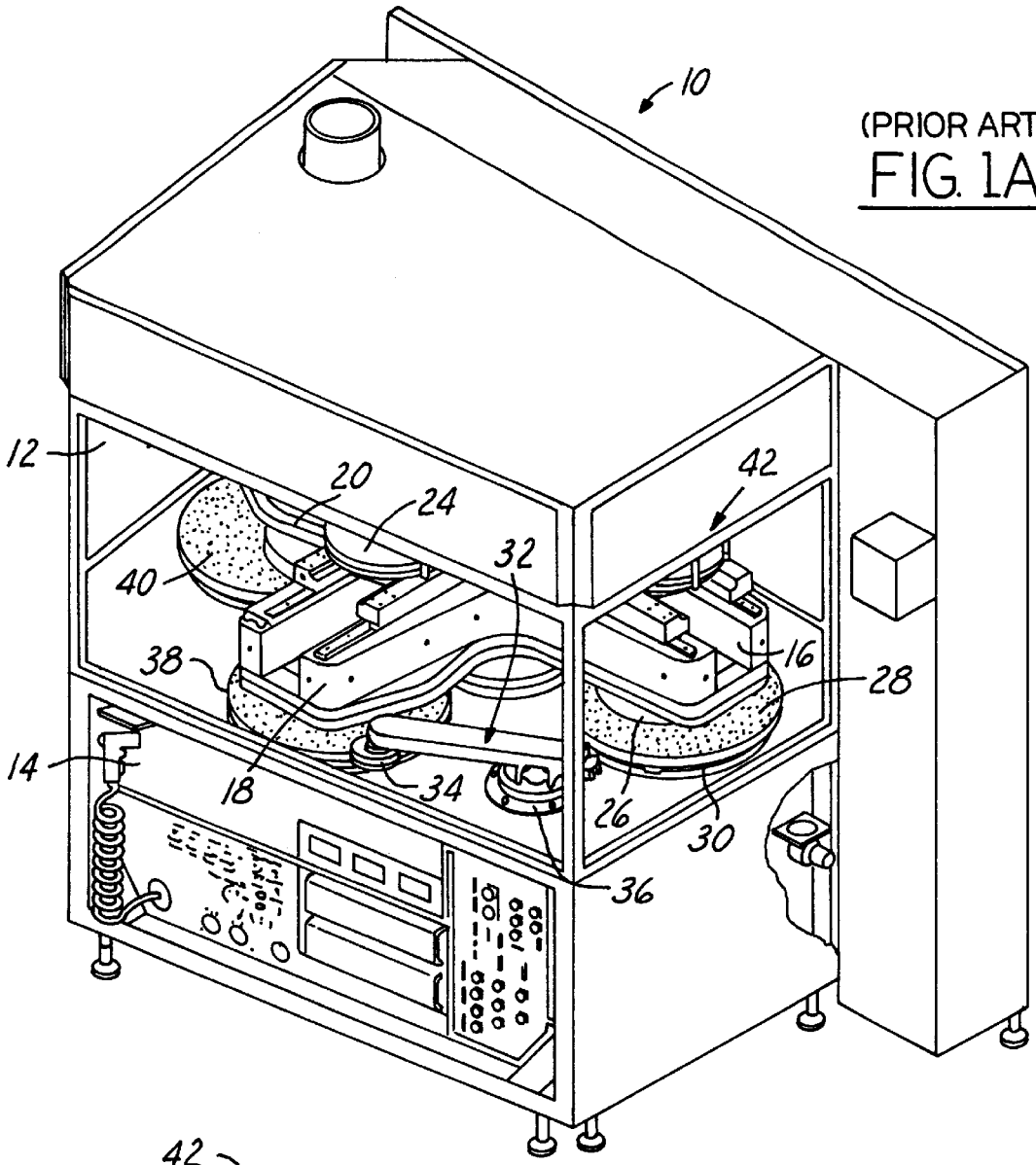
(PRIOR ART) FIG. 1A
FIG. 1A is a perspective view of a conventional chemical mechanical polishing apparatus equipped with multiple polishing stations.
Figure 1B:
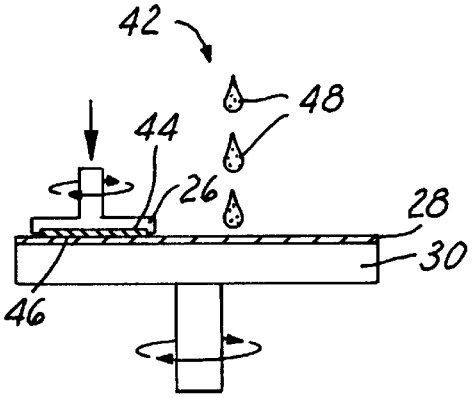
(PRIOR ART) FIG. 1B
FIG. 1B is a cross-sectional view of a wafer carrier with a wafer mounted therein engaging a polishing pad.
Figure 1C:
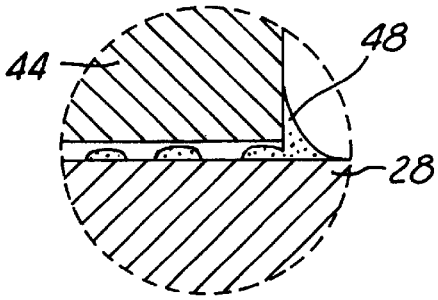
(PRIOR ART) FIG. 1C
FIG. 1C is an enlarged, cross-sectional view illustrating the slurry interaction between a wafer surface and a polishing pad surface.
Figure 2:
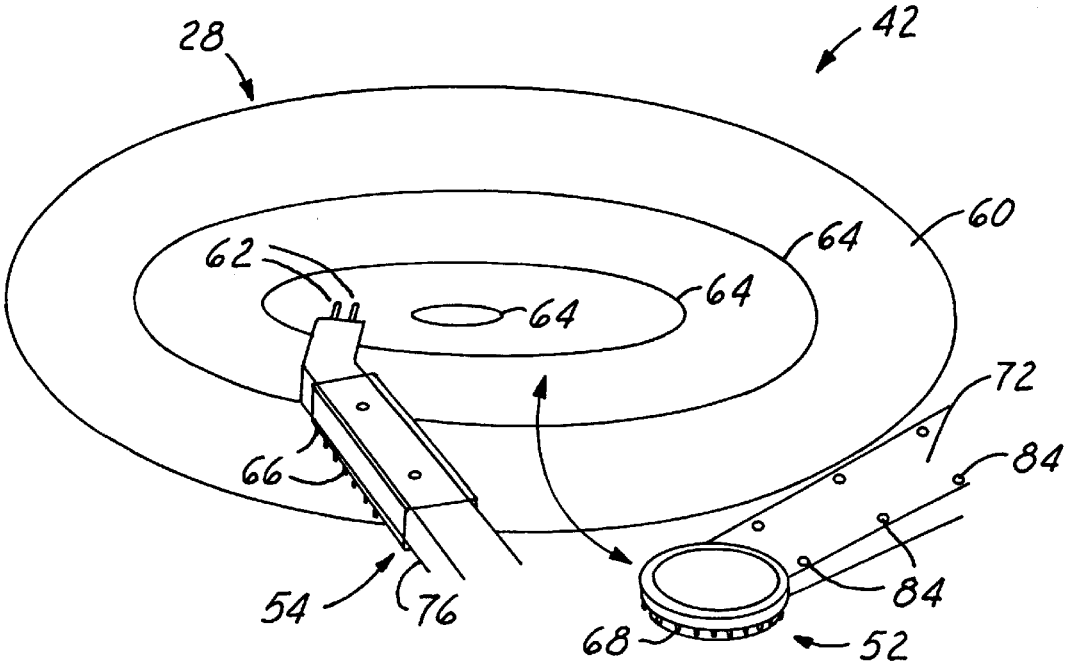
(Prior Art) FIG. 2
FIG. 2 is a perspective view of a polishing station, a slurry dispensing arm and a conditioning arm in the conventional mechanical polishing apparatus.
Figure 3:
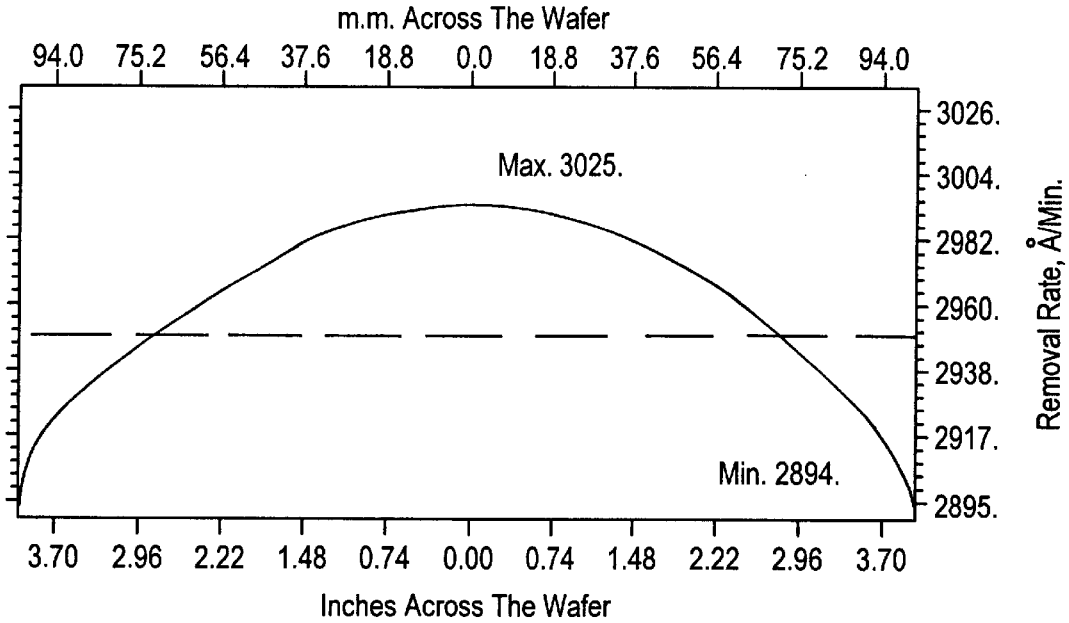
(Prior Art) FIG. 3
FIG. 3 is a graph illustrating the dependency of removal rates on the distance across a wafer surface for a copper chemical mechanical polishing process.
Figure 4:
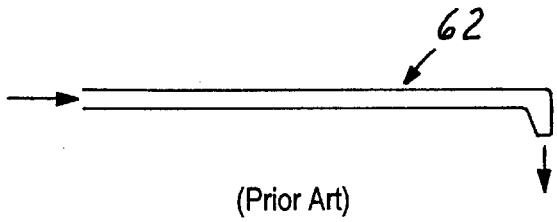
(Prior Art) FIG. 4
FIG. 4 is a cross-sectional view of a conventional polishing slurry dispensing unit.
Figure 6:
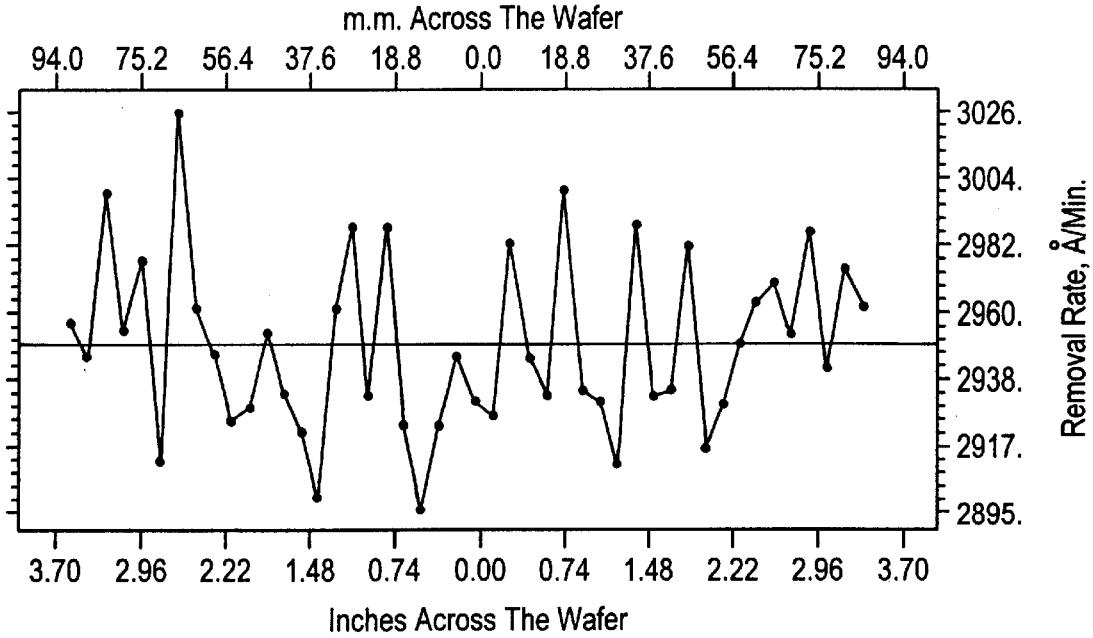
FIG. 6 is a graph illustrating the dependency of removal rates on the distance across a wafer obtained with a present invention slurry dispensing unit.

The effectiveness of the present invention slurry dispensing unit equipped with multiple adjustable nozzles is shown in FIG. 6 in a plot of removal rates against distance across the wafer for a copper chemical mechanical polishing process. It is seen that the removal rate is essentially constant across the entire wafer surface for a 6 inch wafer producing an average removal rate of about 2950 Å/min. The large variation between the center of the wafer and the edge of the wafer in the conventional CMP apparatus with a single nozzle slurry dispenser shown in FIG. 3 is completely eliminated. By utilizing the present invention novel slurry dispensing unit, the variation between the removal rates obtained at different locations on a wafer surface can be quickly reduced, i.e. to less than 1%. This is a great improvement from 4–5% previously obtained utilizing the conventional slurry dispensing unit that is equipped with only a single dispensing nozzle.

The present invention novel slurry dispensing unit for a chemical mechanical polishing apparatus that is equipped with multiple fixed nozzles or multiple adjustable nozzles has therefore been amply described in the above description and in the appended drawings of FIGS. 5 and 6.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows.

What is claimed is:

1. A slurry dispenser for a chemical mechanical polishing apparatus comprising:

a dispenser body having a delivery conduit, a return conduit and a U-shape conduit connected in fluid communication therein between for flowing continuously a slurry solution therethrough; and a plurality of nozzles integrally connected to and in fluid communication with a fluid passageway in said delivery conduit for dispensing a slurry solution.

2. A slurry dispenser for a chemical mechanical polishing apparatus according to claim 1, wherein said plurality of nozzles each having an opening that is the same in size as the openings of its immediately adjacent nozzles.

3. A slurry dispenser for a chemical mechanical polishing apparatus according to claim 1, wherein said plurality of nozzles each having an opening that is different in size than the openings of its immediately adjacent nozzles.

4. A slurry dispenser for a chemical mechanical polishing apparatus according to claim 1, wherein said plurality of nozzles each having an opening that is between about 0.5 mm and about 5 mm in diameter.

5. A slurry dispenser for a chemical mechanical polishing apparatus according to claim 1, wherein said plurality of nozzles each having an opening that is controlled by an adjustable flow control valve.

6. A slurry dispenser for a chemical mechanical polishing apparatus according to claim 1, wherein said plurality of nozzles each having an opening for controlling a slurry dispensing rate between about 0.1 ml/sec. and about 10 ml/sec.

7. A slurry dispenser for a chemical mechanical polishing apparatus according to claim 1, wherein said plurality of nozzles comprises at least four nozzles.

8. A slurry dispenser for a chemical mechanical polishing apparatus according to claim 1, wherein said plurality of nozzles comprises one nozzle for each 12.5 mm spacing on a semiconductor wafer.

9. A slurry dispenser for a chemical mechanical polishing apparatus according to claim 1, wherein said plurality of nozzles comprises sixteen nozzles when said dispenser is adapted for dispensing slurry on a 300 mm semiconductor wafer.

10. A slurry dispenser for a chemical mechanical polishing apparatus according to claim 1, wherein said plurality of nozzles each having an opening that is controlled by a pneumatically adjusted flow control valve.

11. A chemical mechanical polishing apparatus for planarizing semiconductor wafers comprising:

a wafer holder for holding a wafer therein and for rotating, traversing the wafer on a polishing pad;

a polishing platen for mounting and rotating a polishing pad thereon;

a conditioning arm for operating a conditioning disk mounted thereon and for conditioning a surface of the polishing pad; and a slurry dispenser having a body portion of a delivery conduit, a return conduit and a U-shape conduit connected in fluid communication therein between for flowing continuously a slurry solution therethrough; and a plurality of nozzles integrally connected to and in fluid communication with a fluid passageway in said delivery conduit for dispensing a slurry solution.

12. A chemical mechanical polishing apparatus for planarizing semiconductor wafers according to claim 11, wherein said plurality of nozzles each having an opening that is between about 0.5 mm and about 5 mm in diameter.

13. A chemical mechanical polishing apparatus for planarizing semiconductor wafers according to claim 11, each having an opening that is the same in size as the openings of its immediately adjacent nozzles.

14. A chemical mechanical polishing apparatus for planarizing semiconductor wafers according to claim 11, wherein said plurality of nozzles each having an opening that is different in size than the openings of its immediately adjacent nozzles.

15. A chemical mechanical polishing apparatus for planarizing semiconductor wafers according to claim 11, wherein said plurality of nozzles each having an opening that is controlled by an adjustable flow control valve.

16. A chemical mechanical polishing apparatus for planarizing semiconductor wafers according to claim 11, wherein said plurality of nozzles each having an opening that is controlled by a pneumatically adjusted flow control valve.

17. A chemical mechanical polishing apparatus for planarizing semiconductor wafers according to claim 11, wherein said plurality of nozzles each having an opening for controlling a slurry dispensing rate between about 0.1 ml/sec. and about 10 ml/sec.

18. A chemical mechanical polishing apparatus for planarizing semiconductor wafers according to claim 11, wherein said plurality of nozzles comprises at least four nozzles.

19. A chemical mechanical polishing apparatus for planarizing semiconductor wafers according to claim 11, wherein said plurality of nozzles comprises one nozzle for each 12.5 mm spacing on a semiconductor wafer.

20. A chemical mechanical polishing apparatus for planarizing semiconductor wafers according to claim 11, wherein said plurality of nozzles comprises sixteen nozzles when said dispenser is adapted for dispensing slurry on a 300 mm semiconductor wafer.

* * * * *